US010556775B2

(12) United States Patent
Wesson et al.

(10) Patent No.: US 10,556,775 B2
(45) Date of Patent: Feb. 11, 2020

(54) SURFACE CONSTRUCTION OF ELEVATOR BELT

(71) Applicant: OTIS ELEVATOR COMPANY, Farmington, CT (US)

(72) Inventors: John P. Wesson, West Hartford, CT (US); Daniel A. Mosher, Glastonbury, CT (US); Scott Alan Eastman, Glastonbury, CT (US)

(73) Assignee: OTIS ELEVATOR COMPANY, Farmington, CT (US)

( * ) Notice: Subject to any disclaimer, the term of this patent is extended or adjusted under 35 U.S.C. 154(b) by 312 days.

(21) Appl. No.: 15/412,537

(22) Filed: Jan. 23, 2017

(65) Prior Publication Data

US 2017/0225925 A1 Aug. 10, 2017

Related U.S. Application Data

(60) Provisional application No. 62/293,078, filed on Feb. 9, 2016.

(51) Int. Cl.

| | |
|---|---|
| ***B66B 7/06*** | (2006.01) |
| ***B66B 9/00*** | (2006.01) |
| ***B66B 11/00*** | (2006.01) |

(52) U.S. Cl.

CPC ..... *B66B 7/062* (2013.01); *B66B 9/00* (2013.01); *B66B 11/0045* (2013.01)

(58) Field of Classification Search

CPC ..... B66B 7/062; B66B 11/0045

See application file for complete search history.

(56) References Cited

U.S. PATENT DOCUMENTS

| | | | |
|---|---|---|---|
| 4,227,041 | A | 10/1980 | Den et al. |
| 6,364,061 | B2 | 4/2002 | Baranda et al. |
| 6,672,046 | B1 | 1/2004 | Prewo et al. |
| 6,868,661 | B2 | 3/2005 | Aulanko et al. |
| 7,670,240 | B2 | 3/2010 | Pitts et al. |

(Continued)

FOREIGN PATENT DOCUMENTS

| | | | |
|---|---|---|---|
| CN | 1298367 | A | 6/2001 |
| CN | 1499008 | A | 5/2004 |

(Continued)

OTHER PUBLICATIONS

European Search Report and Written Opinion; European Application No. 17155282.1; International Filing Date: Feb. 8, 2017; dated Jun. 27, 2017; 9 pages.

(Continued)

*Primary Examiner* — Diem M Tran

(74) *Attorney, Agent, or Firm* — Cantor Colburn LLP

(57) ABSTRACT

A belt for suspending and/or driving an elevator car includes a plurality of tension elements extending longitudinally along a length of the belt, and a jacket at least partially encapsulating the plurality of tension elements. The jacket defines a traction surface of the belt configured to be interactive with a drive sheave and a back surface opposite the traction surface. The jacket is formed from a first material. One or more material strips are located at one or more of the traction surface or the back surface to improve one or more operational characteristics of the belt. The one or more material strips formed from a second material different from the first material.

14 Claims, 7 Drawing Sheets

(56) References Cited

U.S. PATENT DOCUMENTS

| | | | | |
|---|---|---|---|---|
| 8,052,820 | B2 | 11/2011 | O'Donnell et al. | |
| 8,100,796 | B2 | 1/2012 | O'Donnell | |
| 8,444,515 | B2 | 5/2013 | Baranda et al. | |
| 8,449,349 | B2 | 5/2013 | Thompson et al. | |
| 8,479,888 | B2 | 7/2013 | Goser | |
| 8,673,433 | B2 | 3/2014 | Reif et al. | |
| 8,677,726 | B2 | 3/2014 | Wesson et al. | |
| 8,794,387 | B2 | 8/2014 | Goser | |
| 9,126,805 | B2 | 9/2015 | Pelto-Huikko et al. | |
| 2004/0083707 | A1 | 5/2004 | Eichhorn et al. | |
| 2010/0133046 | A1* | 6/2010 | Allwardt | B66B 7/08 187/251 |
| 2011/0000746 | A1 | 1/2011 | Pelto-Huikko | |
| 2011/0259677 | A1 | 10/2011 | Dudde et al. | |
| 2013/0037353 | A1 | 2/2013 | Phillips et al. | |
| 2014/0076669 | A1 | 3/2014 | Wesson et al. | |
| 2015/0101888 | A1 | 4/2015 | Pelto-Huikko | |
| 2015/0191331 | A1* | 7/2015 | Orelup | D07B 1/22 428/76 |
| 2016/0325966 | A1* | 11/2016 | Papas | B66B 7/062 |
| 2018/0186604 | A1* | 7/2018 | Helenius | D07B 5/006 |

FOREIGN PATENT DOCUMENTS

| | | | | |
|---|---|---|---|---|
| CN | 101875467 | B | 11/2010 | |
| CN | 202247494 | U | 5/2012 | |
| CN | 102954148 | A | 3/2013 | |
| CN | 102985350 | A | 3/2013 | |
| CN | 103443012 | A | 12/2013 | |
| CN | 106115436 | A | 11/2016 | |
| EP | 2913288 | A1 * | 9/2015 | B66B 7/062 |

OTHER PUBLICATIONS

Chinese Office Action Issued in CN Application No. 201710070143.3, dated Oct. 29, 2019, 27 Pages.

* cited by examiner

SURFACE CONSTRUCTION OF ELEVATOR BELT

CROSS-REFERENCE TO RELATED APPLICATIONS

This application claims the benefit of Provisional Application No. 62/293,078 filed Feb. 9, 2016, which is incorporated herein by reference in its entirety.

BACKGROUND

The subject matter disclosed herein relates to belts such as those used in elevator systems for suspension and/or driving of the elevator car and/or counterweight.

Conventional elevator systems use rope formed from steel wires as a lifting tension load bearing member. Other systems utilize a belt formed from a number of steel cords, formed from steel wires, retained in a polymer jacket formed from, for example, thermoplastic polyurethane. The cords act as the load supporting tension member, while the jacket holds the cords in a stable position relative to each other, and provides a frictional load path to provide traction for driving the belt.

Elevator belt surfaces need to meet specific performance and life requirements. Two critical requirements are traction within a specified range and wear sufficient to meet life targets, in some instances in the range of 10-20 years. Conventional belts are based on single elastomer jacket materials at the operating traction and non-traction surfaces.

Complex formulations containing elastomers, polymeric additives, waxes, friction modifiers, carbon black and other additives make up the jacket composition. These single formulations are expected to meet all requirements over a range of varying conditions for the life of the belt. However, variations can and do occur owing to changes in surface composition due to temperature, aging and wear. In addition, uneven pressure and slip across a width of the belt can lead to uneven wear. The high wear typically occurs at locations on the belt where the combination of slip and pressure is the highest. The center of the belt is typically subject to high pressure and low slip, the sections of the belt closest to each edge, lower pressure and higher slip.

Complete wearing of a section of the belt down to the inner tension members results in end of life. Strategies have been proposed to develop robust and complex formulations to improve jacket performance. Unfortunately this approach is complex and requires requalification of the jacket material. In addition, the goal of meeting multiple requirements over a product lifetime is difficult.

SUMMARY

In one embodiment, a belt for suspending and/or driving an elevator car includes a plurality of tension elements extending longitudinally along a length of the belt, and a jacket at least partially encapsulating the plurality of tension elements. The jacket defines a traction surface of the belt configured to be interactive with a drive sheave and a back surface opposite the traction surface. The jacket is formed from a first material. One or more material strips are located at one or more of the traction surface or the back surface to improve one or more operational characteristics of the belt. The one or more material strips formed from a second material different from the first material.

Additionally or alternatively, in this or other embodiments the second material is configured to counteract wear of the belt.

Additionally or alternatively, in this or other embodiments the second material is one of a wear resistant elastomer, a wear resistant fabric or an elastomer having friction properties different from the first material.

Additionally or alternatively, in this or other embodiments the one or more material strips are applied over the traction surface.

Additionally or alternatively, in this or other embodiments one or more grooves are formed in the jacket, and the one or more material strips are inserted into the one or more grooves.

Additionally or alternatively, in this or other embodiments the jacket includes a retaining feature to mechanically connect the one or more material strips to the first jacket material.

Additionally or alternatively, in this or other embodiments one or more material strips are positioned at the back surface of the belt, opposite the traction surface.

Additionally or alternatively, in this or other embodiments one or more undercuts are located in the jacket in regions of predicted high levels of wear.

Additionally or alternatively, in this or other embodiments the one or more material strips are located at one or more belt width ends.

Additionally or alternatively, in this or other embodiments one or more of the jacket or the material strips are formed from one or more of polyurethane, styrene butadiene rubber, nitrile rubber, neoprene, fluoroelastomer, silicone rubber, room temperature vulcanizate, natural rubber, or EPDM.

Additionally or alternatively, in this or other embodiments one or more of the jacket or the material strips include one or more additives of small molecule additives such as liquids, oils, paraphinic waxes, ionic liquids, fire retardants, or particulate additives such as inorganics or organics.

In another embodiment, an elevator system includes a hoistway, and an elevator car positioned in the hoistway and drivable along the hoistway. A drive sheave is positioned in the hoistway and a belt is operably connected to the elevator car and the drive sheave to drive the elevator car along the hoistway. The belt includes a plurality of tension elements extending longitudinally along a length of the belt and a jacket at least partially encapsulating the plurality of tension elements. The jacket defines a traction surface of the belt configured to be interactive with the drive sheave and a back surface opposite the traction surface. The jacket is formed from a first material. One or more material strips are positioned at one or more of the traction surface or the back surface to improve one or more operational characteristics of the belt. The one or more material strips are formed from a second material different from the first material.

Additionally or alternatively, in this or other embodiments the second material is configured to counteract wear of the belt.

Additionally or alternatively, in this or other embodiments the second material is one of a wear resistant elastomer, a wear resistant fabric or an elastomer having friction properties different from the first material.

Additionally or alternatively, in this or other embodiments the one or more material strips are applied over the traction surface.

Additionally or alternatively, in this or other embodiments one or more grooves are formed in the jacket and the one or more material strips are inserted into the one or more grooves.

Additionally or alternatively, in this or other embodiments the jacket includes a retaining feature to mechanically connect the one or more material strips to the jacket.

Additionally or alternatively, in this or other embodiments one or more material strips are positioned at a back surface of the belt, opposite the traction surface.

Additionally or alternatively, in this or other embodiments one or more undercuts are located in the jacket in regions of predicted wear.

Additionally or alternatively, in this or other embodiments the one or more material strips are positioned at one or more belt width ends.

BRIEF DESCRIPTION OF THE DRAWINGS

The subject matter which is regarded as the present disclosure is particularly pointed out and distinctly claimed in the claims at the conclusion of the specification. The foregoing and other features, and advantages of the present disclosure are apparent from the following detailed description taken in conjunction with the accompanying drawings in which:

DETAILED DESCRIPTION

Figure 1A:
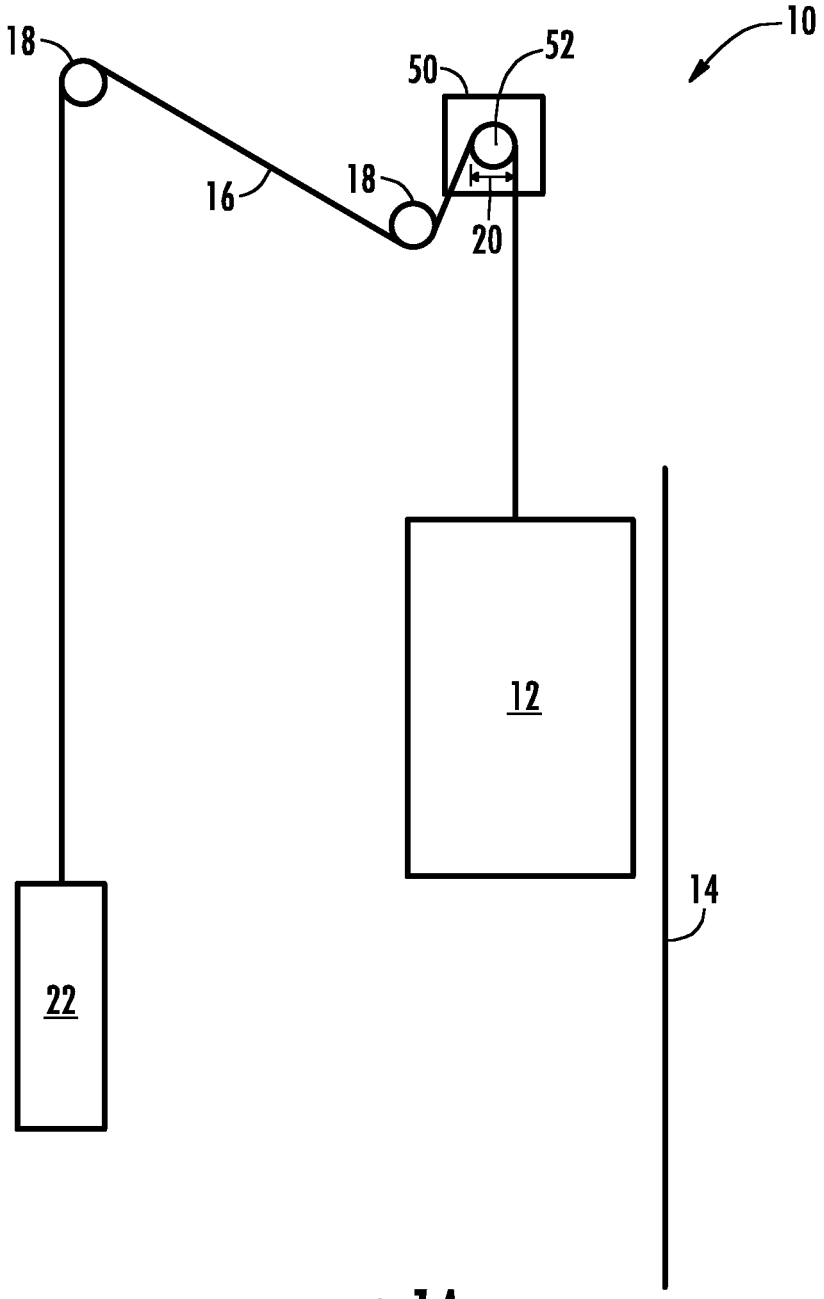
FIG. 1A is a schematic of an exemplary elevator system having a 1:1 roping arrangement.
Figure 1B:
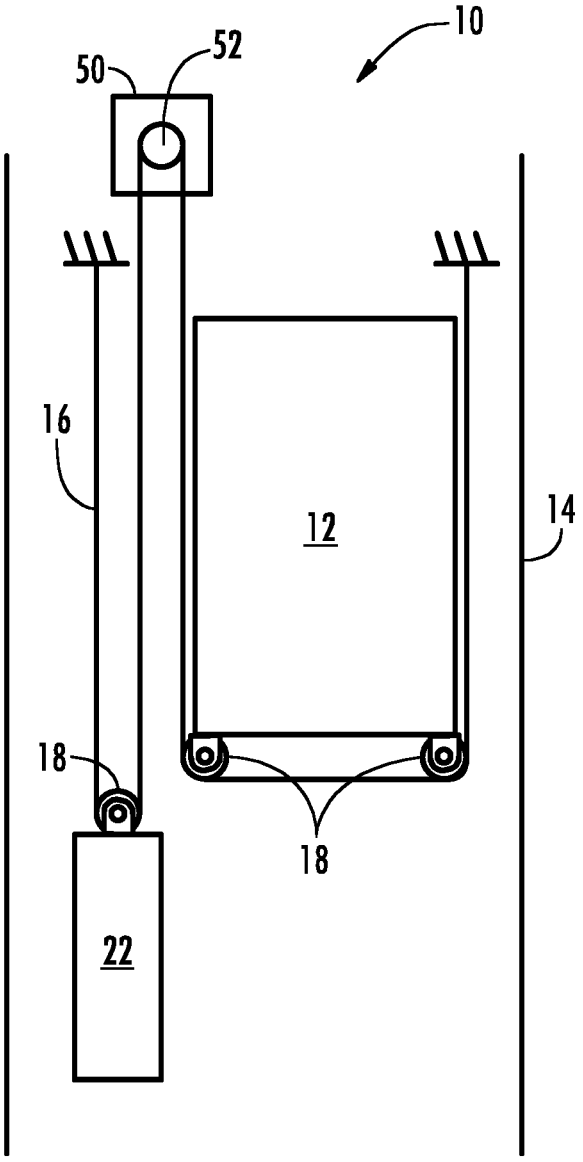
FIG. 1B is a schematic of another exemplary elevator system having a different roping arrangement.
Figure 1C:
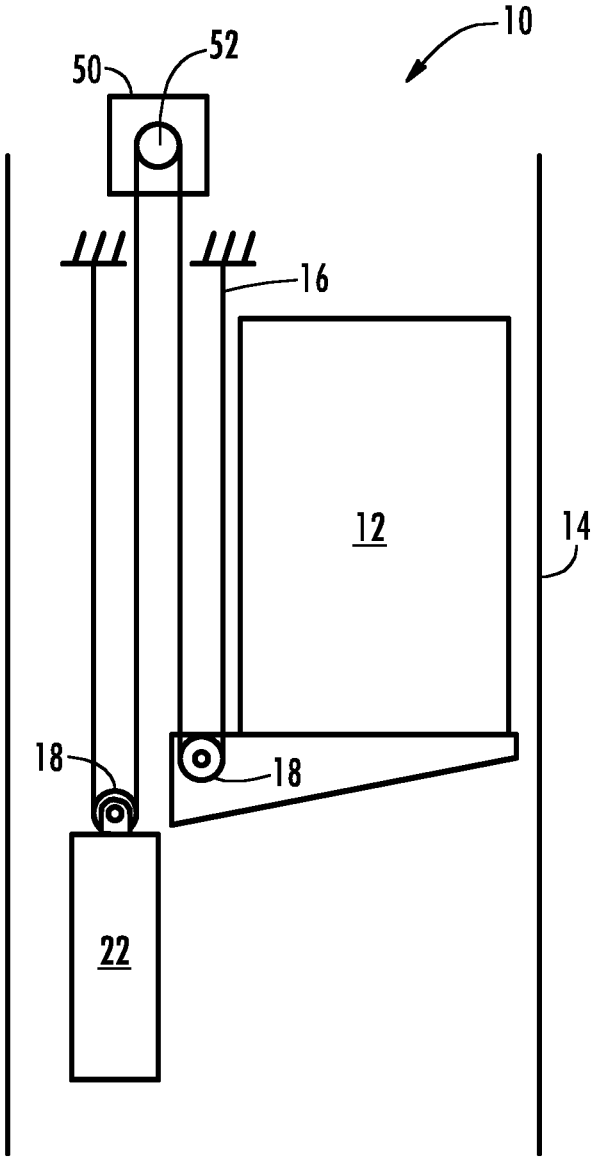
FIG. 1C is a schematic of another exemplary elevator system having a cantilevered arrangement.

Shown in FIGS. 1A, 1B and 1C are schematics of exemplary traction elevator systems 10. Features of the elevator system 10 that are not required for an understanding of the present disclosure (such as the guide rails, safeties, etc.) are not discussed herein. The elevator system 10 includes an elevator car 12 operatively suspended or supported in a hoistway 14 with one or more belts 16. The one or more belts 16 interact with one or more sheaves 18 to be routed around various components of the elevator system 10. The one or more belts 16 could also be connected to a counterweight 22, which is used to help balance the elevator system 10 and reduce the difference in belt tension on both sides of the traction sheave during operation.

The sheaves 18 each have a diameter 20, which may be the same or different than the diameters of the other sheaves 18 in the elevator system 10. At least one of the sheaves would be a traction sheave 52. The traction sheave 52 is driven by a machine 50. Movement of drive sheave by the machine 50 drives, moves and/or propels (through traction) the one or more belts 16 that are routed around the traction sheave 52.

At least one of the sheaves 18 could be a diverter, deflector or idler sheave. Diverter, deflector or idler sheaves are not driven by a machine 50, but help guide the one or more belts 16 around the various components of the elevator system 10.

In some embodiments, the elevator system 10 could use two or more belts 16 for suspending and/or driving the elevator car 12. In addition, the elevator system 10 could have various configurations such that either both sides of the one or more belts 16 engage the one or more sheaves 18 (such as shown in the exemplary elevator systems in FIGS. 1A, 1B or 1C) or only one side of the one or more belts 16 engages the one or more sheaves 18.

FIG. 1A provides a 1:1 roping arrangement in which the one or more belts 16 terminate at the car 12 and counterweight 22. FIGS. 1B and 1C provide different roping arrangements. Specifically, FIGS. 1B and 1C show that the car 12 and/or the counterweight 22 can have one or more sheaves 18 thereon engaging the one or more belts 16 and the one or more belts 16 can terminate elsewhere, typically at a structure within the hoistway 14 (such as for a machineroomless elevator system) or within the machine room (for elevator systems utilizing a machine room). The number of sheaves 18 used in the arrangement determines the specific roping ratio (e.g. the 2:1 roping ratio shown in FIGS. 1B and 1C or a different ratio). FIG. 1C also provides a so-called rucksack or cantilevered type elevator. The present embodiments could also be used on elevator systems other than the exemplary types shown in FIGS. 1A, 1B and 1C.

Figure 2:
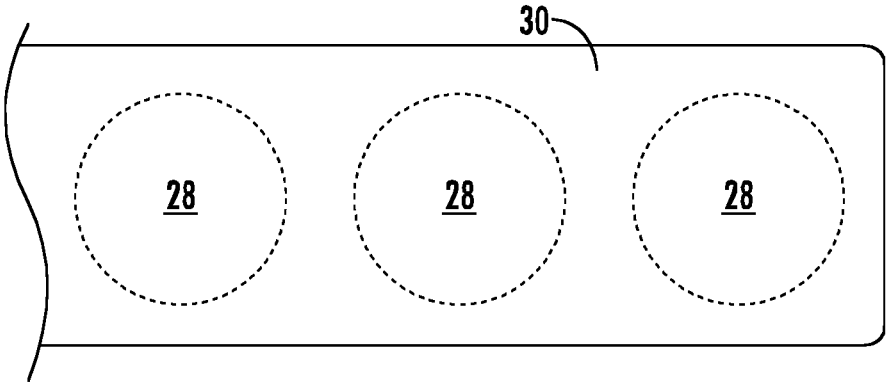
FIG. 2 is an end view of an embodiment of an elevator belt.
Figure 3:
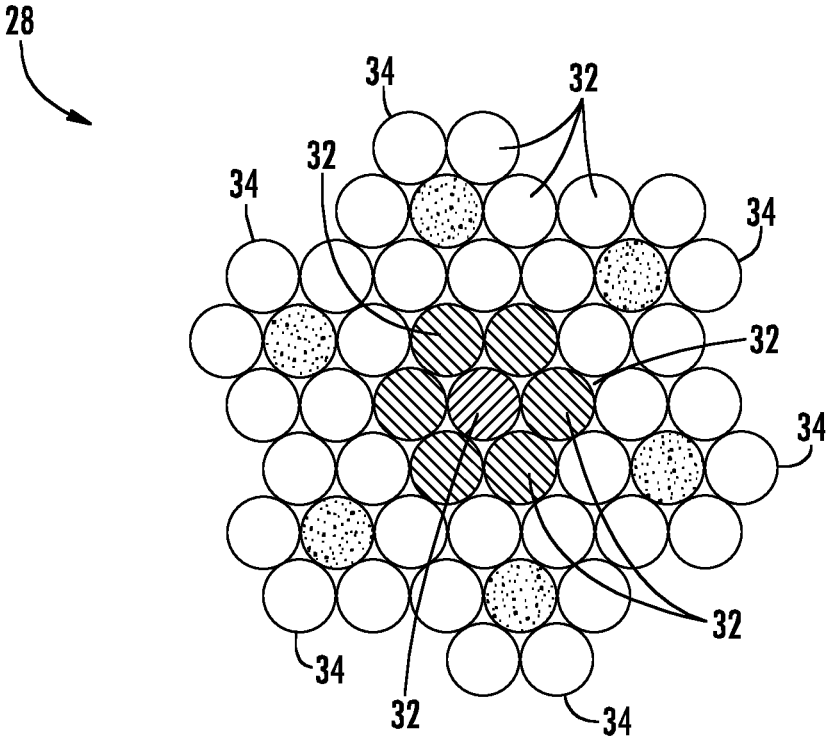
FIG. 3 is a cross-sectional view of an embodiment of a tension element of an elevator belt.

Referring to FIG. 2, a cross-sectional view of an exemplary belt 16 is shown. The belt 16 is constructed of one or more cords 28 in a jacket 30. The cords 28 of the belt 16 may all be identical, or some or all of the cords 28 used in the belt 16 could be different than the other cords 28. For example, one or more of the cords 28 could have a different construction, formed from different materials, or size than the other cords 28. As seen in FIG. 2, the belt 16 has an aspect ratio greater than one (i.e. belt width is greater than belt thickness). Referring to FIG. 3, each cord 28 comprises a plurality of wires 32, which in some embodiments are formed into strands 34, which are then formed into the cord 28.

Referring again to FIG. 2, the belt 16 is constructed to have sufficient flexibility when passing over the one or more sheaves 18 to provide low bending stresses, meet belt life requirements and have smooth operation, while being sufficiently strong to be capable of meeting strength requirements for suspending and/or driving the elevator car 12.

The jacket 30 can substantially retain the cords 28 therein. The phrase substantially retain means that the jacket 30 has sufficient engagement with the cords 28 such that the cords 28 do not pull out of, detach from, and/or cut through the jacket 30 during the application on the belt 16 of a load that can be encountered during use in an elevator system 10 with, potentially, an additional factor of safety. In other words, the cords 28 remain at their original positions relative to the jacket 30 during use in an elevator system 10. The jacket 30 could completely envelop the cords 28 (such as shown in FIG. 2), substantially envelop the cords 28, or at least partially envelop the cords 28.

Figure 4:
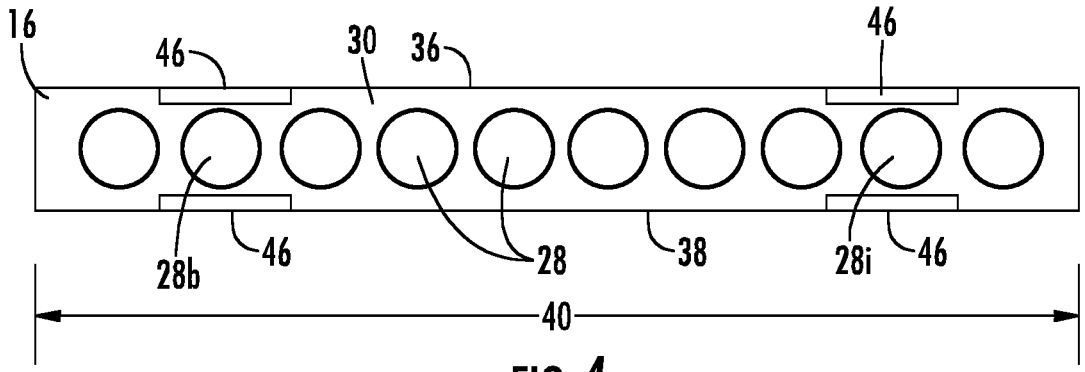
FIG. 4 is a cross-sectional view of an embodiment of an elevator belt.

Referring now to FIG. 4, shown is an embodiment of a belt 16 having 10 cords 28 arrayed along a belt width 40. The belt 16 is roughly rectangular in cross-section and in some embodiments a belt width 40 is in the range of 20-50 millimeters and a belt thickness 42 is in the range of 3-8 millimeters. The jacket 30 includes a traction surface 36 interactive with and contacting the drive sheave 26 and a back surface 38 opposite the traction surface 36. The back surface 38 may be interactive with other sheaves 18, such as diverter, deflector or idler sheaves 18. One or more of the sheaves 18 may have a crowned sheave surface to steer or guide the belt 16. The crowned sheave surface 18, alone or in combination with other factors, results in uneven pressure on the traction surface 36 and/or the back surface 38 causing uneven slip and/or wear of the belt 16. Referring again to FIG. 4, the belt 16 includes material strips 46 on the traction surface 36 to counteract high wear of select portions of the traction surface 36 due to, for example, uneven pressure on the traction surface 36 during operation of the elevator system 10. In one embodiment, the material strips are applied over cord 28*b* and cord 28*i*, corresponding to anticipated high levels of wear in those areas of belt 16. The material strips 46 are configured to counteract high levels of wear and may be formed from, for example, a wear resistant elastomer, a wear resistant fabric or an elastomer with higher or lower friction properties to raise or lower the friction and traction of the belt 16. In particular, a lower friction material is beneficial to help reduce wear of the belt 16, and may include a damped material to reduce belt 16 noise during operation. Further, in some embodiments, material strips 46 may be utilized not only at the traction surface 36 but at the back surface 38 in addition to or as an alternative to material strips 46 at the traction surface 36. In some embodiments, the material strips 46 cover 5% to 50% of the traction surface 36. Application of material strips 46 is not limited to over cord 28*b* and 28*i*, but in some embodiments may be applied at other locations of the traction surface 36 and/or the back surface 38. For example, in some embodiments, a material strip 46 of a low coefficient of friction material may be applied at a center of the traction surface 36 to promote microslip at the belt 16 center, while reducing microslip at outboard regions of the belt 16. In some embodiments, material strips 46 in different belt 16 locations may be formed from different materials to enhance different properties of the belt 16 operation.

The jacket 30 and material strips 46 may be formed from of any of but not limited to the following materials: polyurethane, styrene butadiene rubbers, nitrile rubber, neoprene, fluoroelastomer, silicone rubber, room temperature vulcanizates, natural rubber, EPDM.

Materials utilized in the jacket 30 and/or the material strips 46 may have additives which influence friction, traction and wear properties. These additives may include but are not limited to small molecule additives such as liquids, oils, paraphinic waxes, ionic liquids, fire retardants etc. Other additives could also include blends of other polymers, or particulate additives such as inorganics (clay, glass, etc.) or organics (rubber, etc.). Any combination of additives can be incorporated at a range of total additive concentration from 0.001 wt. % to 50 wt. %; more specifically 0.01 wt. % to 25 wt. % and even more specifically 0.01 wt. % to 15 wt. %.

Figure 5:
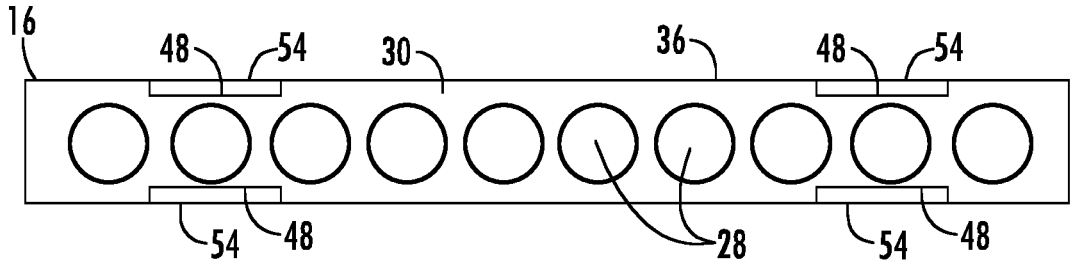
FIG. 5 is a cross-sectional view of another embodiment of an elevator belt.

In some embodiments, as shown in FIG. 4, the material strips 46 are applied over the traction surface 36, and may be added during the extrusion process used to form the jacket 30 over the cords 28. Alternatively, the material strips 46 may be imparted to the traction surface 36 during a mold wheel operation, after extrusion of the jacket 30. Referring now to FIG. 5, in some embodiments, a groove 48 is formed in the jacket 30, either during extrusion or in a post-extrusion process. An additive material 54 is added into the groove 48 to change the belt 16 performance, reducing wear of the belt 16, compared to a belt without the additive material 54 of the material strips 46. The additive material 54 is added in a post extrusion process, such as thermal fusion or adhesion of a secondary tape or fabric including the additive material 54 to the groove 48. This allows for standardization of the jacket 30 manufacturing process and also the manufacturing process of the additive material 54. The additive material 54 may include fluoropolymers, polyesters or other thermoplastic materials. Additional exemplary materials include uncoated or coated fabrics, such as Kevlar, graphite, urethane, rubber or other materials to modify friction properties of the belt 16. Further, in some embodiments, the additive material 54 may be utilized not only at the traction surface 36 but at the back surface 38.

Figure 6:
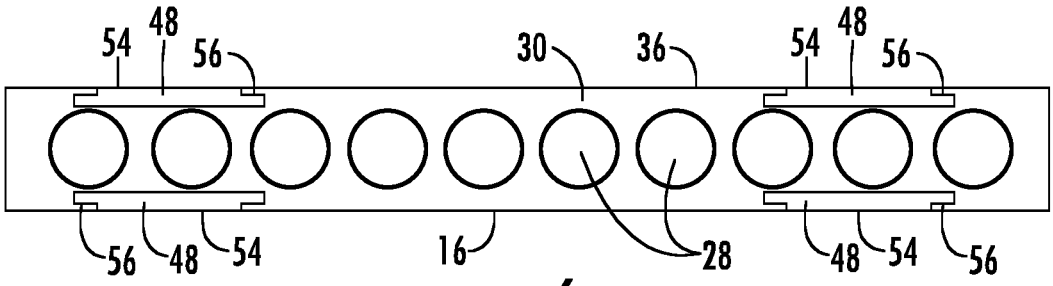
FIG. 6 is a cross-sectional view of yet another embodiment of an elevator belt.

Referring now to FIG. 6, in some embodiments, the groove 48 may have an interlocking notch 56 extending outwardly from the groove 48, into which the additive material 54 may be inserted to lock the additive material 54 in place at the groove 48. In an alternate embodiment, the locking feature of 54 is preformed in the second material and integrated into the belt 16 during the primary extrusion operation of the jacket material.

Figure 7:
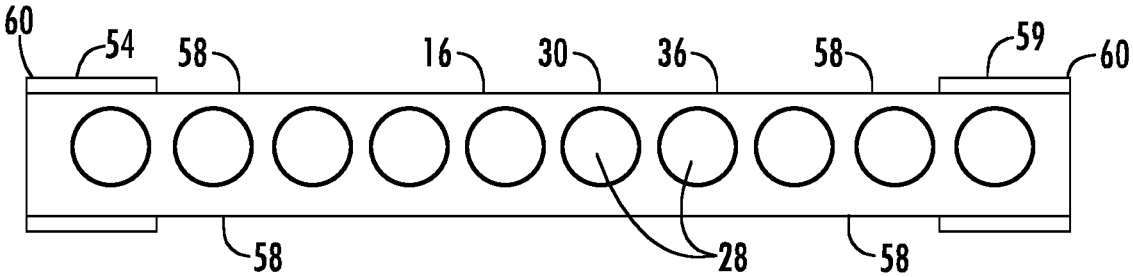
FIG. 7 is a cross-sectional view of still another embodiment of an elevator belt.
Figure 8:
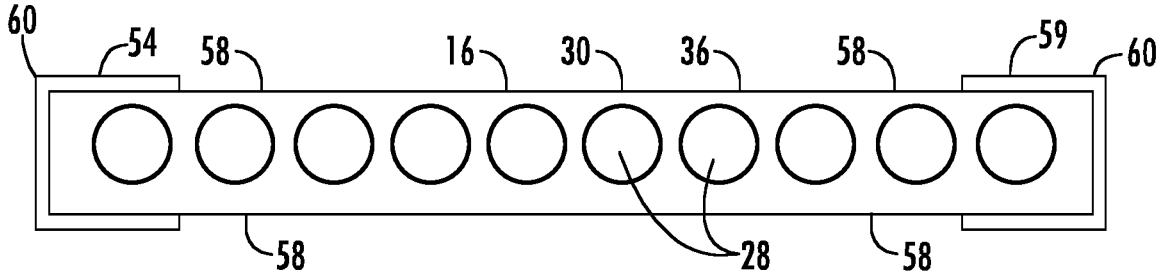
FIG. 8 is a cross-sectional view of another embodiment of an elevator belt.

In another embodiment, as illustrated in FIG. 7, the belt 16 may include undercuts 58 where material is removed from the jacket 30 in locations where high degrees of wear are predicted. Such configurations move high pressure and/or slip to other locations along the belt 16. In addition, belt 16 thickness may be enhanced in other regions, such as belt width ends 60. Wear in the normal wear track, such as at cords 28*b* and 28*i* is deferred until the additional material is removed via wear from the belt width ends 60. Further, the material added at the belt width ends 60 may be a wear resistant material or fabric. Such modifications may be through the extrusion process of the jacket 30 and/or via a secondary process. In some embodiments, such as shown in FIG. 8, the additive materials 54 may be wrapped around an edge surface 62 of the belt 16 from the traction surface 36 to the back surface 38.

The configurations disclosed herein allow for modifications to a base belt 16 configuration to address performance issues such as wear, slip and noise through the use of added features such as material strips 46 and additive materials 54. These features may be added without changing the manufacturing processes of the baseline belt 16.

While the disclosure has been described in detail in connection with only a limited number of embodiments, it should be readily understood that the disclosure is not limited to such disclosed embodiments. Rather, the disclosure can be modified to incorporate any number of variations, alterations, substitutions or equivalent arrangements not heretofore described, but which are commensurate with the spirit and scope of the disclosure. Additionally, while various embodiments have been described, it is to be understood that aspects of the disclosure may include only some of the described embodiments. Accordingly, the disclosure is not to be seen as limited by the foregoing description, but is only limited by the scope of the appended claims.

The invention claimed is:

1. A belt for suspending and/or driving an elevator car, comprising:

a plurality of tension elements extending longitudinally along a length of the belt;

a jacket at least partially encapsulating the plurality of tension elements, the jacket defining a traction surface of the belt configured to be interactive with a drive sheave and a back surface opposite the traction surface, the jacket formed from a first material;

one or more material strips disposed at one or more of the traction surface or the back surface to improve one or more operational characteristics of the belt, the one or more material strips formed from a second material different from the first material; and one or more grooves formed in the jacket, wherein the one or more material strips are inserted into the one or more grooves, the one or more grooves including an interlocking notch extending laterally along a width direction of the belt into which the one or more material strips are inserted to lock the one or more material strips in place at the one or more grooves.

2. The belt of claim 1, wherein the second material is configured to counteract wear of the belt.

3. The belt of claim 1, wherein the second material is one of a wear resistant elastomer, a wear resistant fabric or an elastomer having friction properties different from the first material.

4. The belt of claim 1, wherein the one or more material strips are applied over the traction surface.

5. The belt of claim 1, further comprising one or more material strips disposed at the back surface of the belt, opposite the traction surface.

6. The belt of claim 1, further comprising locating the one or more material strips at one or more belt width with end regions.

7. The belt of claim 1, wherein one or more of the jacket or the material strips are formed from one or more of polyurethane, styrene butadiene rubber, nitrile rubber, neoprene, fluoroelastomer, silicone rubber, room temperature vulcanizate, natural rubber, or EPDM.

8. The belt of claim 1, wherein one or more of the jacket or the material strips include one or more additives of small molecule additives such as liquids, oils, paraphinic waxes, ionic liquids, fire retardants, or particulate additives such as inorganics or organics.

9. An elevator system, comprising:

a hoistway;

an elevator car disposed in the hoistway, and drivable along the hoistway;

a drive sheave disposed in the hoistway; and a belt operably connected to the elevator car and the drive sheave to drive the elevator car along the hoistway, the belt including:

a plurality of tension elements extending longitudinally along a length of the belt;

a jacket at least partially encapsulating the plurality of tension elements, the jacket defining a traction surface of the belt configured to be interactive with the drive sheave and a back surface opposite the traction surface, the jacket formed from a first material; and one or more material strips disposed at one or more of the traction surface or the back surface to improve one or more operational characteristics of the belt, the one or more material strips formed from a second material different from the first material; and one or more grooves formed in the jacket, wherein the one or more material strips are inserted into the one or more grooves, the grooves including an interlocking notch extending laterally along a width direction of the belt into which the material strips are inserted to lock the material strip in place at the groove.

10. The elevator system of claim 9, wherein the second material is configured to counteract wear of the belt.

11. The elevator system of claim 9, wherein the second material is one of a wear resistant elastomer, a wear resistant fabric or an elastomer having friction properties different from the first material.

12. The elevator system of claim 9, wherein the one or more material strips are applied over the traction surface.

13. The elevator system of claim 9, further comprising one or more material strips disposed at a back surface of the belt, opposite the traction surface.

14. The elevator system of claim 9, further comprising locating the one or more material strips at one or more belt width with end regions.

* * * * *